United States Patent [19]

Chezem

[11] 4,042,265

[45] Aug. 16, 1977

[54] WEDGE-TYPE LIMIT STOP FOR OUTWARD OPENING DOOR

[76] Inventor: Jimmie A. Chezem, Rte. 9, Box 164A, Sparta, Tenn. 38583

[21] Appl. No.: 736,195

[22] Filed: Oct. 27, 1976

[51] Int. Cl.[2] ..... E05C 17/06

[52] U.S. Cl. ..... 292/262; 70/93

[58] Field of Search ..... 292/342, 290, 297, 298, 292/262, 268; 70/93

[56] References Cited

U.S. PATENT DOCUMENTS

| | | | |
|---|---|---|---|
| 1,877,263 | 9/1932 | Beauchamp | 292/342 X |
| 1,919,780 | 7/1933 | Fairbank | 292/342 X |
| 3,989,291 | 11/1976 | Hucknall | 292/262 |

*Primary Examiner*—Richard E. Moore

*Attorney, Agent, or Firm*—Clarence A. O'Brien; Harvey B. Jacobson

[57] ABSTRACT

An elongated wedge member is pivotally supported at its minor dimension end on the free swinging edge of a door for swinging relative to the door about an axis generally paralleling the axis about which the door may be swung and for movement of the wedge member between first and second active and inactive positions with the wedge projecting outwardly of the inner side of the door and swung toward the hinged edge of the door overlying the inner side thereof, respectively. In addition, an elongated tapered and open-sided channel member is provided and has its minor dimension end pivotally supported from the jamb of the aforementioned door for swinging about an axis generally paralleling the pivot axis of the door and movement between first and second active and inactive positions with the channel member projecting outwardly of the inner side of the jamb and swung away from the door overlying the inner side of the jamb. The wedge and channel member are registrable with each other when the door is in the closed position and the wedge and channel member are in their active positions and the wedge is swingable into the channel member through the open side thereof. Further, the wedge is seatingly engageable in the channel member upon movement of the door toward an open position and the longitudinal shifting of the wedge within the channel member toward the minor dimension end thereof. The position of the free swinging edge of the door relative to the associated jamb when the wedge is seated in the channel member is such that the free swinging edge of the door is swung slightly from the jamb to define a narrow slot through which a person disposed on the inner side of the door may view the area to the exterior side of the door.

8 Claims, 5 Drawing Figures

WEDGE-TYPE LIMIT STOP FOR OUTWARD OPENING DOOR

BACKGROUND OF THE INVENTION

Various forms of door stops and catches have been provided as security means for inward swinging doors whereby the inward swinging doors may be only partially opened and then prevented against further opening until such time as a person disposed on the inner side of the door may ascertain that it is safe to further open the door. However, similar security devices for outward swinging doors are substantially non-existent. Accordingly, a need exists for a security catch for outward swinging doors that will enable the latter to be partially opened and then prevented against further swinging toward open positions until such time as a person disposed on the inner side of the door may ascertain that it is safe to open the door further.

BRIEF DESCRIPTION OF THE INVENTION

The limit stop of the instant invention has been specifically designed for use in conjunction with outward swinging doors and is constructed in a manner whereby the limit stop may be rendered operable when the associated door is in the closed position and may subsequently function to limit opening of the door until a person disposed to the interior of the door may ascertain that it is safe to further open the door in an outward direction.

The limit stop is constructed in a manner whereby it may be readily applied to substantially all forms of outward swinging doors and is therefore adaptable for use in numerous environments.

The main object of this invention is to provide a limit stop for limiting swinging movement of an outward swinging door to an open position.

Another object of this invention is to provide a limit stop in accordance with the preceding object and which may be readily attached to existing outward swinging doors and their associated doorjambs.

Another important object of this invention is to provide a limit stop which is functional in generally the same manner as a safety chain provided on an inward swinging door.

Still another object of this invention is to provide a limit stop for outward swinging doors which will offer a greater degree of security than that which is normally achieved through the utilization of safety chains operatively associated with inward swinging doors.

A final object of this invention to be specifically enumerated herein is to provide a limit stop for outward swinging doors and which will conform to conventional forms of manufacture, be of simple construction and easy to install so as to provide a device that will be economically feasible, long lasting and relatively trouble free in installation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
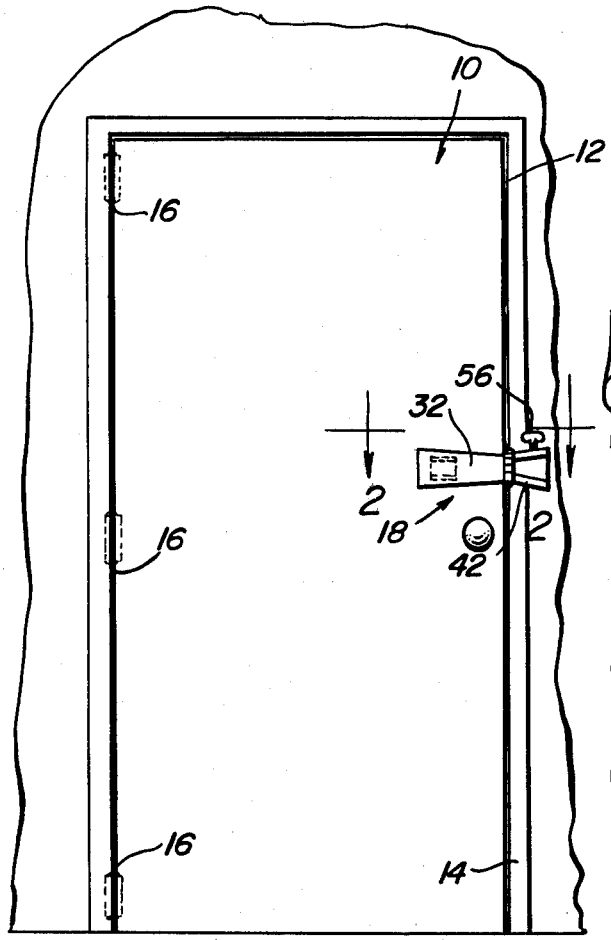
FIG. 1 is an inside elevational view of an outward swinging door with the limit stop of the instant invention operatively associated therewith.

Referring now more specifically to the drawings, the numeral 10 generally designates an outward swinging door mounted within a door opening 12 defined within a doorjamb 14. The door 10 is hingedly supported from the jamb 14 by means of hinges 16 and the door 10 is swingable in an outward direction when being opened.

The stop of the instant invention is referred to in general by the reference numeral 18 and includes a mounting plate 20 secured to the inner surface 22 of the door 10 adjacent the free swinging edge thereof 24 by means of fasteners 26. The plate 20 extends inwardly from the free swinging edge 24 and has a magnet structure 28 supported from the inner surface of the end thereof remote from the free swinging edge 24.

The end of the mounting plate 20 adjacent the free swinging edge 24 of the door 10 has the minor dimension end 30 of an elongated plate-like wedge 32 swingably supported therefrom by means of a hinge structure 34 and the wedge 32 is swingable from an active position disposed substantially normal to the door 10 toward an inactive position closely overlying the mounting plate 20 and magnetically attracted thereto by means of the magnet 28, the wedge 32 being constructed of ferrous materials. Further, the hinge 34 has a torsion spring 36 operatively associated therewith and connected between the plate 20 and the wedge 32 whereby the wedge 32 is yieldingly biased toward the active position thereof illustrated in solid lines in FIG. 3. However, the magnet 28 is of sufficient strength to resist the thrust applied to the wedge 32 by the spring 36 and thereby serves to maintain the wedge 32 in the inactive position against the biasing action of the spring 36 until such time as the wedge 32 is manually displaced from the inactive position thereof.

The limit stop 18 further includes a second mounting plate 38 secured to the inner surface of the jamb 14 by means of suitable fasteners 40 and a flat open-sided and tapering channel member 42 has its major dimension end 44 pivotally supported from the mounting plate 38 by means of a hinge assembly 46. The channel member 42 includes convergent opposite side longitudinal retaining flanges 48 and 50 which converge toward the hinge assembly 46 and the channel member 42 is swingable between an inoperative position such as that illustrated in solid lines in FIG. 1 of the drawings closely overlying the mounting plate 38 and an operative position such as that illustrated in phantom lines in FIG. 3 with the major dimension end of the channel member 42 projecting outwardly from the inner side of the jamb 14.

Figure 2:
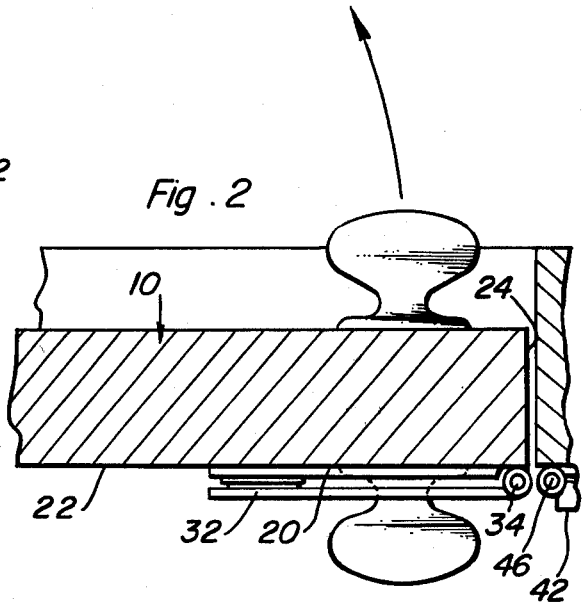
FIG. 2 is a fragmentary enlarged horizontal sectional view taken substantially upon the plane indicated by the section line 2—2 of FIG. 1.
Figure 4:
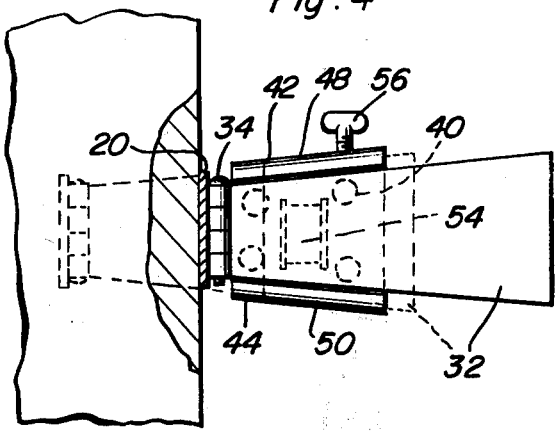
FIG. 4 is a fragmentary elevational view of the limit stop in an operative position immediately prior to the associated door being swung outwardly from a fully closed position and with parts of the door and limit stop broken away and illustrated in vertical section.

When the channel member 42 is in the operative position, the door 10 is closed and the wedge 32 is in the operative position the wedge 32 is receivable into the channel member 42 through the open side thereof in the manner illustrated in FIG. 4. When in this position, the wedge 32 and channel member 42 are retained against swinging movement away from each other by means of a magnet 54 carried by the channel member 42 and magnetically attracting the wedge 32 to the channel member 42. Accordingly, as soon as the door 10 is moved from the closed position thereof illustrated in FIGS. 1, 2 and 4 of the drawings to the partially open position thereof illustrated in FIG. 3 the wedge 32 will seat in the channel member 42 and prevent further swinging movement of the door 10 to the open position.

The retaining flange 48 includes a thumbscrew 56 threaded therethrough and the thumbscrew 56 may be adjusted to limit movement of the door 10 toward the stop position thereof defined by seated engagement of the wedge 32 in the channel member 42.

Figure 3:
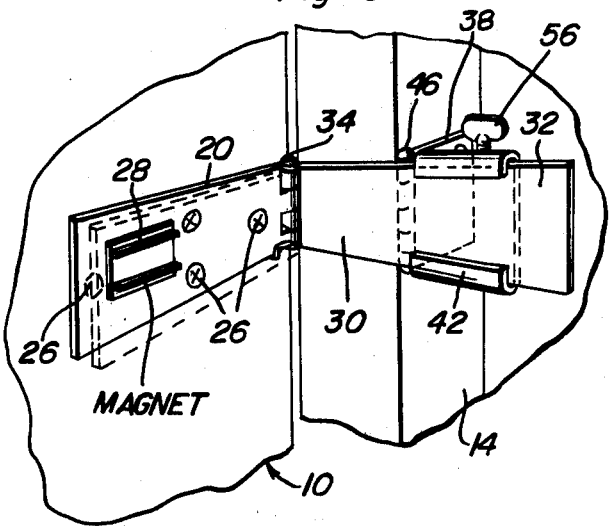
FIG. 3 is a fragmentary perspective view of the limit stop in an operative position limiting outward swinging movement of an outward opening door.
Figure 5:
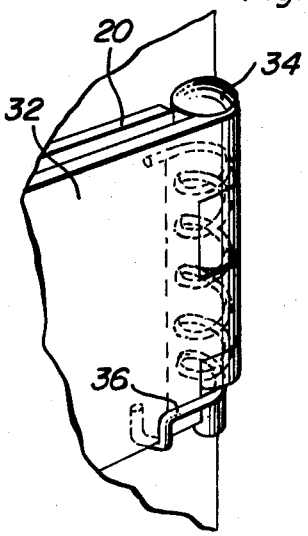
FIG. 5 is an enlarged fragmentary perspective view illustrating the spring construction by which the wedge portion of the limit stop is yieldingly biased toward an inoperative position.

After the door 10 has been partially opened and stopped in the partially open position illustrated in FIG. 3 and it has been ascertained that it is safe to further open the door 10, the door 10 must first be substantially fully closed in order to swing the wedge 32 out of engagement with the channel member 42 after which both the wedge 32 and channel member 42 may be swung to their inoperative positions and the door 10 may be fully opened.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination, a door jamb defining an opening, a door horizontally swingably supported from said jamb for movement between open and closed positions, said jamb and door including corresponding inner and outer sides, an elongated wedge member pivotally supported at its minor dimension end on the free swinging edge of said door for swinging between first and second active and inactive positions with said wedge projecting outwardly of said inner side of said door and swung toward the hinged edge of said door overlying the inner side thereof, respectively, an elongated, tapered and open-sided channel member having its minor dimension end pivotally supported from said jamb for swinging between first and second active and inactive positions with said channel member projecting outwardly of the inner side of said jamb and swung away from said door overlying the inner side of said jamb, respectively, said wedge and channel member paralleling and being registered with each other when said door is in said closed position and said wedge and channel member are in their active positions with said wedge being swingable into said channel member through the open side thereof, said wedge being seatingly engageable in said channel member upon movement of said door toward an open position and longitudinal shifting of said wedge toward the minor dimension end of said channel member.

2. The combination of claim 1 including means yieldingly biasing said wedge toward its active position.

3. The combination of claim 1 including means operative to releasably secure said wedge in the inactive position.

4. The combination of claim 1 including means releasably retaining said wedge and channel member in their active positions with said wedge swung into said channel against swinging movement of said wedge and channel member away from each other.

5. The combination of claim 4 including means yieldingly biasing said wedge toward its active position.

6. The combination of claim 5 including means operative to releasably secure said wedge in the inactive position.

7. The combination of claim 6 including means operative to releasably retain said channel member in said inactive position.

8. The combination of claim 1 wherein said channel member includes means disposed intermediate the opposite ends of one of the convergent opposite longitudinal sides thereof operative to vary the effective transverse interior dimension of said channel member and to thereby vary the relative longitudinally shifted positions of said wedge and channel member when said wedge is seated in said channel member.

* * * * *